US005773927A

United States Patent [19]

Zimlich

[11] Patent Number: 5,773,927

[45] Date of Patent: Jun. 30, 1998

[54] FIELD EMISSION DISPLAY DEVICE WITH FOCUSING ELECTRODES AT THE ANODE AND METHOD FOR CONSTRUCTING SAME

[75] Inventor: David A. Zimlich, Boise, Id.

[73] Assignee: Micron Display Technology, Inc., Boise, Id.

[21] Appl. No.: 520,886

[22] Filed: Aug. 30, 1995

[51] Int. Cl.[6] ..... H01J 1/62

[52] U.S. Cl. ..... 313/495; 313/496; 313/497

[58] Field of Search ..... 313/494, 495, 313/496, 497, 422; 445/24, 46, 51

[56] References Cited

U.S. PATENT DOCUMENTS

| | | | |
|---|---|---|---|
| 3,500,102 | 3/1970 | Crost et al. . | |
| 4,940,916 | 7/1990 | Borel et al. | 313/306 |
| 5,129,850 | 7/1992 | Kane et al. | 445/24 |
| 5,186,670 | 2/1993 | Doan et al. | 445/24 |
| 5,191,217 | 3/1993 | Kane et al. | 250/423 F |
| 5,212,426 | 5/1993 | Kane | 315/169.1 |
| 5,359,256 | 10/1994 | Gray | 313/169 |
| 5,475,280 | 12/1995 | Jones et al. | 313/497 |
| 5,491,376 | 2/1996 | Levins et al. | 313/495 |
| 5,508,584 | 4/1996 | Tsai et al. | 313/497 |
| 5,541,478 | 7/1996 | Troxell et al. | 313/497 |

FOREIGN PATENT DOCUMENTS

| | | | |
|---|---|---|---|
| 0 527 240 A1 | 2/1993 | European Pat. Off. | H01J 63/06 |
| 0 635 865 A1 | 1/1995 | European Pat. Off. | H01J 31/12 |
| 61-088432 | 5/1986 | Japan | H01J 31/15 |
| 62-290050 | 12/1987 | Japan | H01J 31/15 |

OTHER PUBLICATIONS

Cathey, David A. Jr., "Field Emission Displays," Micron Display Technology, Inc., Boise, Idaho, undated.

Lee, Kon Jiun, "Current Limiting of Field Emitter Array Cathodes," Exerpt of Thesis, Georgia Institute of Technology, Aug. 1986.

Yokoo, K. et al. "Active Control of Emission Current of Field Emitter Array," Revue Le Vide, les Couches Minces, vol. 271, Mar./Apr. 1994, pp. 58–61.

*Primary Examiner*—Walter E. Snow
*Assistant Examiner*—Vip Patel
*Attorney, Agent, or Firm*—Seed and Berry LLP

[57] ABSTRACT

A field emission display device includes a baseplate having a set of field-induced electron emitters for each pixel in a display. Each set includes a plurality of emitters each carried by a supporting substrate and disposed within a respective aperture in an insulating layer deposited on the surface of the substrate. A conductive layer is deposited on the insulating layer peripherally about the apertures. A plurality of emitter conductors are each operatively coupled to the emitters of one of the sets of emitters. A conductive voltage applied to the conductive layer and a source voltage applied to one of the emitter conductors causes the emitters coupled to the emitter conductor to each emit an electron emission. The display device also includes a faceplate having a transparent viewing layer positioned in a parallel spaced-apart relationship with the baseplate. An anode is deposited on a planar surface of the viewing layer opposite the sets of emitters. A luminescent layer has a plurality of localized portions each deposited on the anode opposite one of the sets of emitters so that an anode voltage applied to the anode will direct any electron emissions from the emitters toward the localized portions of the luminescent layer. Finally, a plurality of focusing electrodes each comprising a conductive strip are deposited on the planar surface of the viewing layer around the periphery of a respective localized portion of the luminescent layer substantially opposite the respective set of emitters of the localized portion so that a focusing electrode voltage which is less than the anode voltage applied to the focusing electrodes will focus these electron emissions on the localized portions of the luminescent layer.

22 Claims, 4 Drawing Sheets

FIELD EMISSION DISPLAY DEVICE WITH FOCUSING ELECTRODES AT THE ANODE AND METHOD FOR CONSTRUCTING SAME

This invention was made with Government support under Contract No. DABT63-93-C-0025 awarded by Advanced Research Projects Agency (ARPA). The Government has certain rights in this invention.

TECHNICAL FIELD

The present invention relates in general to field emission display devices, and in particular to field emission display devices with focusing electrodes.

BACKGROUND OF THE INVENTION

Conventional field emission flat panel display devices are convenient for use in applications which require display devices having less bulk, weight and power consumption than venerable cathode ray tube (CRT) display devices. As shown in FIG. 1, a conventional field emission display device 10 includes a baseplate 12 having a plurality of field-induced electron emitters 14 carried by a supporting substrate 16. The emitters 14 are disposed within respective apertures in an insulating layer 18 deposited on the surface of the supporting substrate 16. Also, a conductive layer forming an extraction grid 20 is deposited on the insulating layer 18 peripherally about the respective apertures of the emitters 14.

The conventional field emission display device 10 shown in FIG. 1 also includes a faceplate 22 having a transparent viewing layer 24 separated from the baseplate 12 by spacers (not shown) between the faceplate 22 and the baseplate 12. An anode 26 such as an Indium tin oxide layer is deposited on a surface of the viewing layer 24 facing the baseplate 12. Also, localized portions of a luminescent layer 28 are deposited on the anode 26. The luminescent layer 28 typically comprises a phosphorescent material, such as a cathodophosphorescent material, which emits light when bombarded by electrons. A black matrix 30 is deposited on the anode 26 between the localized portions of the luminescent layer 28 to improve the contrast of the field emission display device 10 by absorbing ambient light.

In operation, a conductive voltage $V_c$ such as 40 volts applied to the extraction grid 20 and a source voltage $V_s$ such as 0 volts applied to the emitters 14 creates an intense electric field around the emitters 14. This electric field causes an electron emission to occur from each of the emitters 14 in accordance with the well-known Fowler-Nordheim equation. An anode voltage $V_a$ such as 1,000 volts applied to the anode 26 draws these electron emissions toward the faceplate 22. Some of these electron emissions impact on the localized portions of the luminescent layer 28 and cause the luminescent layer 28 to emit light. In this manner, the field emission display device 10 provides a display. Although the field emission display device 10 is shown in FIG. 1 having only two emitters 14 associated with each localized portion of the luminescent layer 28 for ease of understanding, those with skill in the field of this invention will understand that hundreds of emitters 14 may be associated with each localized portion of the luminescent layer 28 in order to average out individual differences in the electron emissions from different emitters 14.

In a conventional field emission display device configured as a monochrome display, each localized portion of the luminescent layer of the display device comprises one pixel of the monochrome display. Also, in a conventional field emission display device configured as a color display, each localized portion of the luminescent layer comprises a green, red or blue sub-pixel of the color display, and a green, a red and a blue sub-pixel together comprise one pixel of the color display. As a result, each pixel in a monochrome display and each sub-pixel in a color display is uniquely associated with one of the localized portions of the luminescent layer and hence is uniquely associated with a set of emitters.

If the electron emission from an emitter associated with a first localized portion of the luminescent layer of a conventional field emission display device also impacts on a second localized portion of the luminescent layer, then it causes both localized portions to emit light. As a result, a first pixel or sub-pixel uniquely associated with the first localized portion correctly turns on, and a second pixel or sub-pixel uniquely associated with the second localized portion incorrectly turns on. In a color display this can cause, for example, a purple light to be emitted from a blue sub-pixel and a red sub-pixel together when only a red light from the red sub-pixel was desired. This is obviously problematic because it provides a poor display.

This problem can be referred to as bleedover, and it can occur because the electron emission from each emitter in a conventional field emission display device tends to spread out from the baseplate of the display device. If the electron emission is allowed to spread out too far, it will impact on more than one localized portion of the luminescent layer of the display device. The likelihood that bleedover will occur is exacerbated by any misalignment between each localized portion of the luminescent layer and its associated set of emitters.

In conventional field emission display devices, bleedover is alleviated in three ways. First, the anode voltage $V_a$ applied to the anode of the conventional display device is a relatively high voltage such as 1,000 volts so the electron emissions from the emitters of the display device are rapidly accelerated toward the anode. As a result, the electron emissions have less time to spread out. Second, the gap between the baseplate and the faceplate of the conventional display device is relatively small, again giving the electron emissions less time to spread out. Third, the localized portions of the luminescent layer of the conventional display device are spaced relatively far from one another because of the relatively low display resolution provided by the conventional field emission display device. As a result, the electron emissions impact on the correct localized portion of the luminescent layer before they have a chance to impact on an incorrect localized portion.

However, as display designers attempt to increase the display resolution of the conventional field emission display device to provide a superior display, they necessarily crowd the localized portions of the luminescent layer of the display device closer together. As a result, bleedover begins to occur.

One solution to this problem might seem to be to decrease the distance between the faceplate and the baseplate of the conventional field emission display device. If this distance is decreased, the electron emissions from the emitters of the display device have less time to spread out and cause bleedover. However, it has been found that this is an impractical solution because the anode voltage $V_a$ applied to the anode of the display device needs to be as much as 1,000 volts or more in practice in order to adequately accelerate the electron emissions toward the anode. If the distance between the faceplate and the baseplate is decreased, arcing begins to occur between the faceplate and the baseplate because of this relatively high voltage. If, instead, the anode voltage $V_a$ is increased in order to accelerate the electron emissions toward the anode more rapidly and thereby prevent bleedover, arcing also begins to occur between the faceplate and the baseplate. Thus, there seems to be no practical way to both increase the display resolution of the conventional field emission display device and successfully prevent bleedover.

Therefore, there is a need in the art for a high display resolution field emission display device which successfully prevents bleedover.

SUMMARY OF THE INVENTION

In a preferred embodiment the present invention provides an electronic system including a display device having a baseplate and a faceplate. The baseplate includes an insulating layer having a plurality of apertures therein positioned on the surface of a supporting substrate. The baseplate also includes a plurality of field-induced electron emitters each carried by the supporting substrate and disposed within a respective aperture in the insulating layer. The baseplate further includes a conductive layer positioned on the insulating layer peripherally about the apertures therein such that a conductive voltage applied to the conductive layer and a source voltage applied to the emitters will cause an electron emission to occur from each of the emitters. The faceplate includes a substantially transparent viewing layer positioned in a substantially parallel spaced-apart relationship with the baseplate and having a substantially planar surface facing the baseplate. The faceplate also includes an anode positioned on the substantially planar surface of the viewing layer opposite the emitters such that an anode voltage applied to the anode will direct the electron emissions from the emitters toward the anode. The faceplate further includes a luminescent layer positioned on the anode opposite the emitters such that at least some of the electron emissions directed toward the anode will bombard a localized portion of the luminescent layer and cause it to emit light and to provide a display. Finally, the faceplate includes a focusing electrode including a conductive strip positioned on the substantially planar surface of the viewing layer around the periphery of the localized portion of the luminescent layer substantially opposite the emitters such that a focusing electrode voltage applied to the focusing electrode which is less than the anode voltage will focus the electron emissions directed toward the anode on the localized portion of the luminescent layer.

In another embodiment the present invention provides a method for constructing a display device. The method includes: providing a supporting substrate having a field-induced electron emitter disposed thereon; depositing an insulating layer on the surface of the supporting substrate such that it covers the emitter; depositing a conductive layer on the insulating layer; removing portions of the conductive and insulating layers so that the emitter is exposed and is disposed within an aperture in the conductive and insulating layers; providing a substantially transparent viewing layer in a substantially parallel spaced-apart relationship with the supporting substrate and having a surface facing the supporting substrate; providing an anode on the surface of the viewing layer opposite the emitter; providing a luminescent layer having a localized portion positioned on the anode opposite the emitter; and positioning a focusing electrode comprising a conductive strip on the substantially planar surface of the viewing layer around the periphery of the localized portion of the luminescent layer substantially opposite the emitter.

The present invention thus advantageously provides a display device which successfully prevents bleedover even at high display resolutions by employing a focusing electrode at the anode.

BRIEF DESCRIPTION OF THE DRAWINGS

These and other features of the present invention will become better understood with regard to the following description, appended claims, and accompanying drawings where:

DETAILED DESCRIPTION OF THE INVENTION

Figure 1:
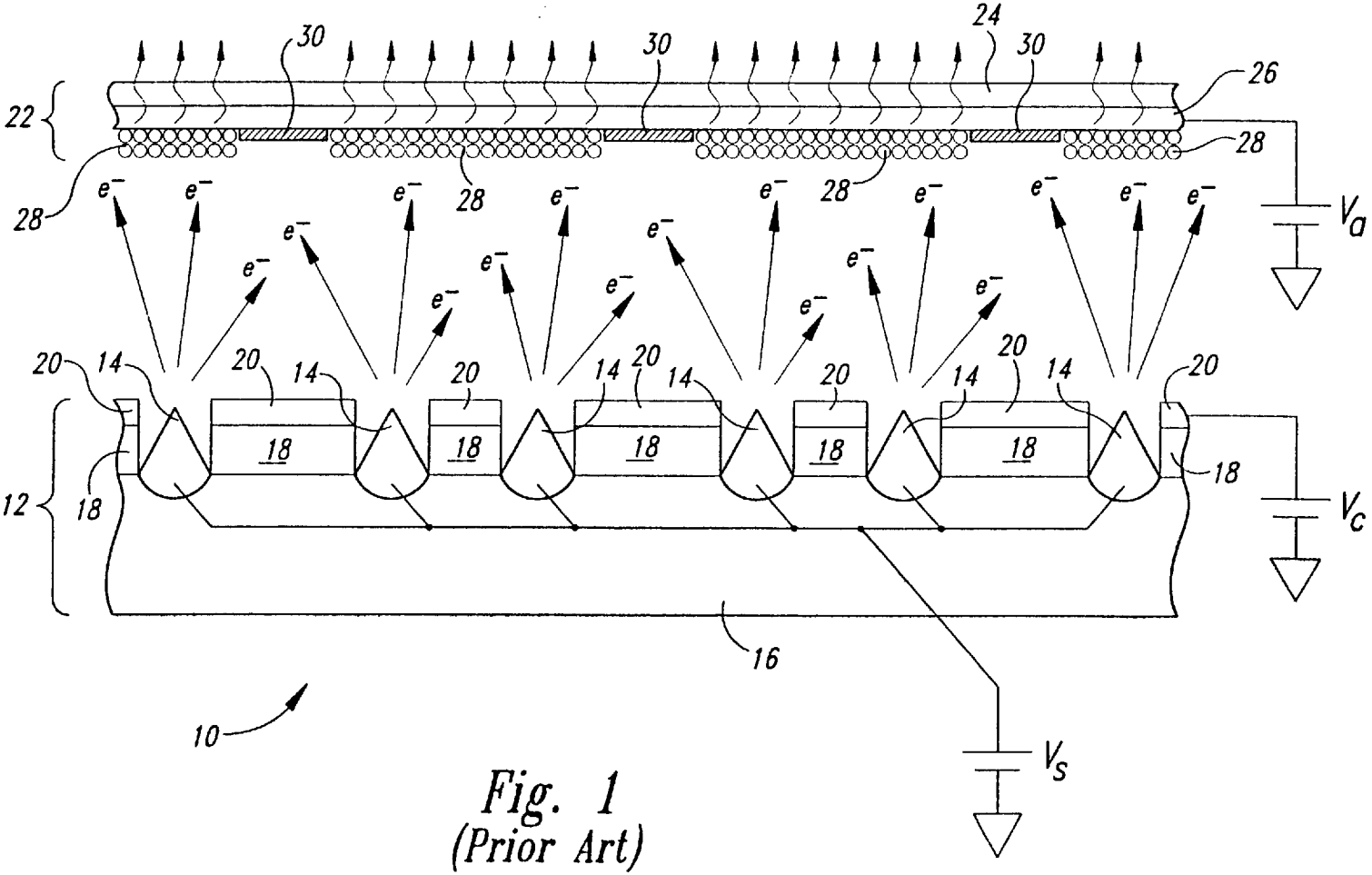
Fig. 1 (Prior Art)
FIG. 1 is a side sectional and schematic view of a conventional field emission display device.
Figure 2:
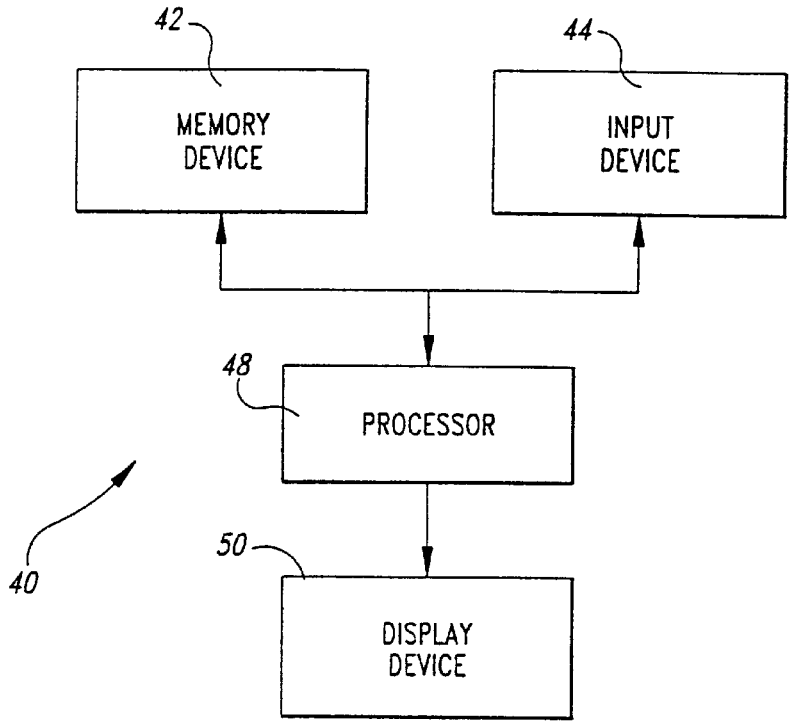
FIG. 2 is block diagram of a preferred computer system according to the present invention.

In a preferred embodiment of the present invention shown in FIG. 2, an electronic system 40 comprises a memory device 42, such as a RAM; and an input device 44, such as a keyboard or a source of video signals, both operatively coupled to a processor 48. The processor 48 is, in turn, operatively coupled to a display device 50. Those with skill in the field of this invention will understand that this preferred electronic system can be embodied in a variety of devices including personal computers, televisions, video cameras, electronic entertainment devices, and other electronic devices which use a display device.

Figure 3:
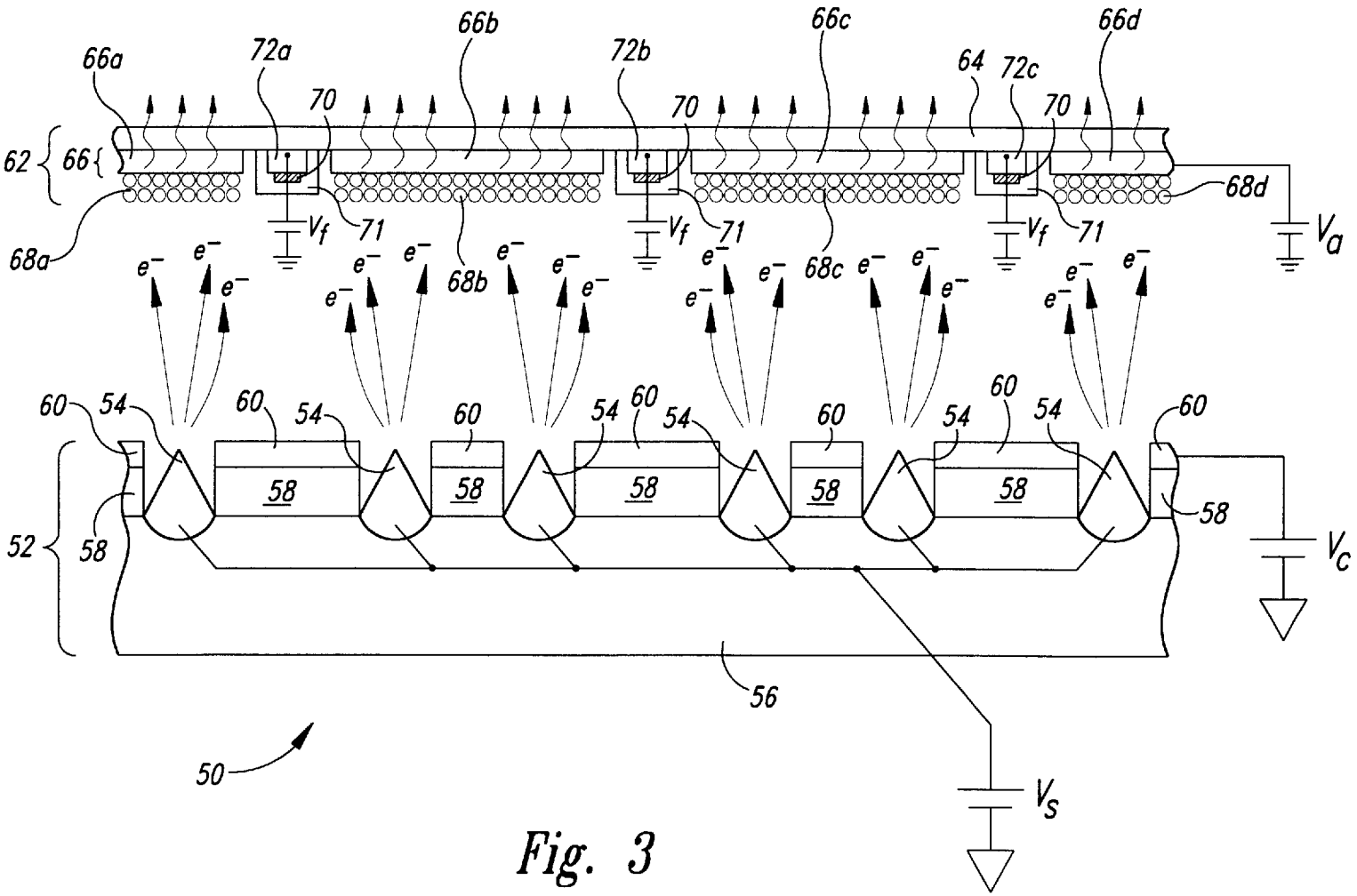
FIG. 3 is a side sectional and schematic view of a display device of the preferred computer system of FIG. 2.

The preferred display device 50 of FIG. 2 is shown in more detail in FIG. 3. It includes a baseplate 52 having a plurality of field-induced electron emitters 54 carried by a supporting substrate 56. Each emitter 54 is disposed within a respective aperture in an insulating layer 58 deposited on the surface of the supporting substrate 56. A conductive layer forming an extraction grid 60 is deposited on the insulating layer 58 peripherally about the respective apertures of the emitters 54.

The preferred display device 50 of FIG. 3 also includes a faceplate 62 having a substantially transparent viewing layer 64 positioned in a substantially parallel spaced-apart relationship with the baseplate 52 by spacers (not shown). An anode 66, such as an Indium tin oxide layer, having localized portions 66*a*, 66*b*, 66*c* and 66*d* is deposited on a substantially planar surface of the viewing layer 64 facing the baseplate 52 opposite respective sets of emitters 54*a*, 54*b*, 54*c* and 54*d*. Localized portions of a luminescent layer 68*a*, 68*b*, 68*c* and 68*d* are each deposited on respective localized portions of the anode 66*a*, 66*b*, 66*c* and 66*d*. The luminescent layer 68 comprises a phosphorescent material which emits light when bombarded by electrons. A plurality of focusing electrodes 72*a*, 72*b* and 72*c* comprising conductive strips are deposited on the substantially planar surface of the viewing layer 64 around the periphery of respective localized portions of the anode 66*a*, 66*b*, 66*c* and 66*d* substantially opposite the respective sets of emitters 54*a*, 54*b*, 54*c* and 54*d*. In addition, a black matrix 70 which can be conductive is deposited on the plurality of focusing electrodes 72*a*, 72*b*, and 72*c* between the localized portions of the anode 66*a*, 66*b*, 66*c*, and 66*d*. Finally, an insulating layer 71 encloses each of the focusing electrodes 72*a*, 72*b*, and 72*c* and the black matrix 70.

In operation, a conductive voltage $V_c$ such as 40 volts applied to the conductive layer 60 and a source voltage $V_s$ such as 0 volts applied to the emitters 54 causes an electron emission to occur from each of the emitters 54 as previously described. An anode voltage $V_a$ such as 1,000 volts applied to each localized portion of the anode 66*a,* 66*b,* 66*c* and 66*d* attracts these electron emissions toward the faceplate 62. Some of these electron emissions bombard the localized portions of the luminescent layer 68*a,* 68*b,* 68*c* and 68*d* and cause these localized portions to emit light and thereby provide a display. Although the display device 50 is shown in FIG. 3 having only two emitters 54 associated with each of the localized portions of the luminescent layer 68*a,* 68*b,* 68*c* and 68*d* for ease of understanding, those with skill in the field of this invention will understand that many more emitters 54 are preferably associated with each of the localized portions of the luminescent layer 68*a,* 68*b,* 68*c* and 68*d* in order to average out individual differences in the electron emissions from different emitters 54.

As with the previously described conventional field emission display device, the electron emissions from the emitters 54 attempt to spread out. In the conventional field emission display device this would cause the previously described bleedover. However, in the present invention a focusing electrode voltage $V_f$ such as 500 volts is applied to each of the focusing electrodes 72*a,* 72*b* and 72*c*. Because of the voltage differential between the focusing electrodes 72*a,* 72*b* and 72*c* and the localized portions of the anode 66*a,* 66*b,* 66*c* and 66*d,* the electron emissions from the emitters 54 are deflected toward their respective localized portion of the anode 66*a,* 66*b,* 66*c* and 66*d* and are thus prevented from causing bleedover.

Figure 4:
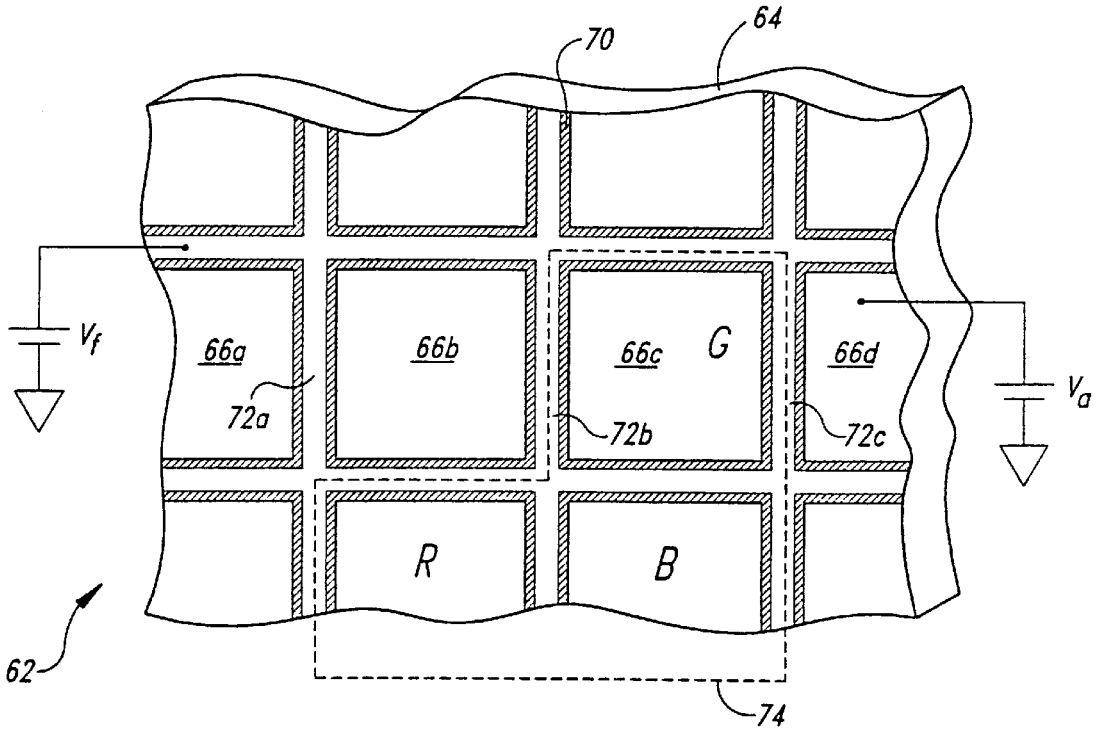
FIG. 4 is a bottom plan view of a faceplate of the preferred display device of FIG. 3.

The preferred faceplate 62 of the display device 50 is shown in more detail in FIG. 4. The localized portions of anode 66*a,* 66*b,* 66*c* and 66*d* are deposited on the substantially planar surface of the viewing layer 64 and are surrounded by the focusing electrodes 72*a,* 72*b* and 72*c*. The black matrix 70 is deposited between the localized portions of the anode 66*a,* 66*b,* 66*c* and 66*d*. In a color display, three localized portions of the anode can be combined to form one pixel 74 of the color display having a red R, a green G, and a blue B sub-pixel.

Figure 5:
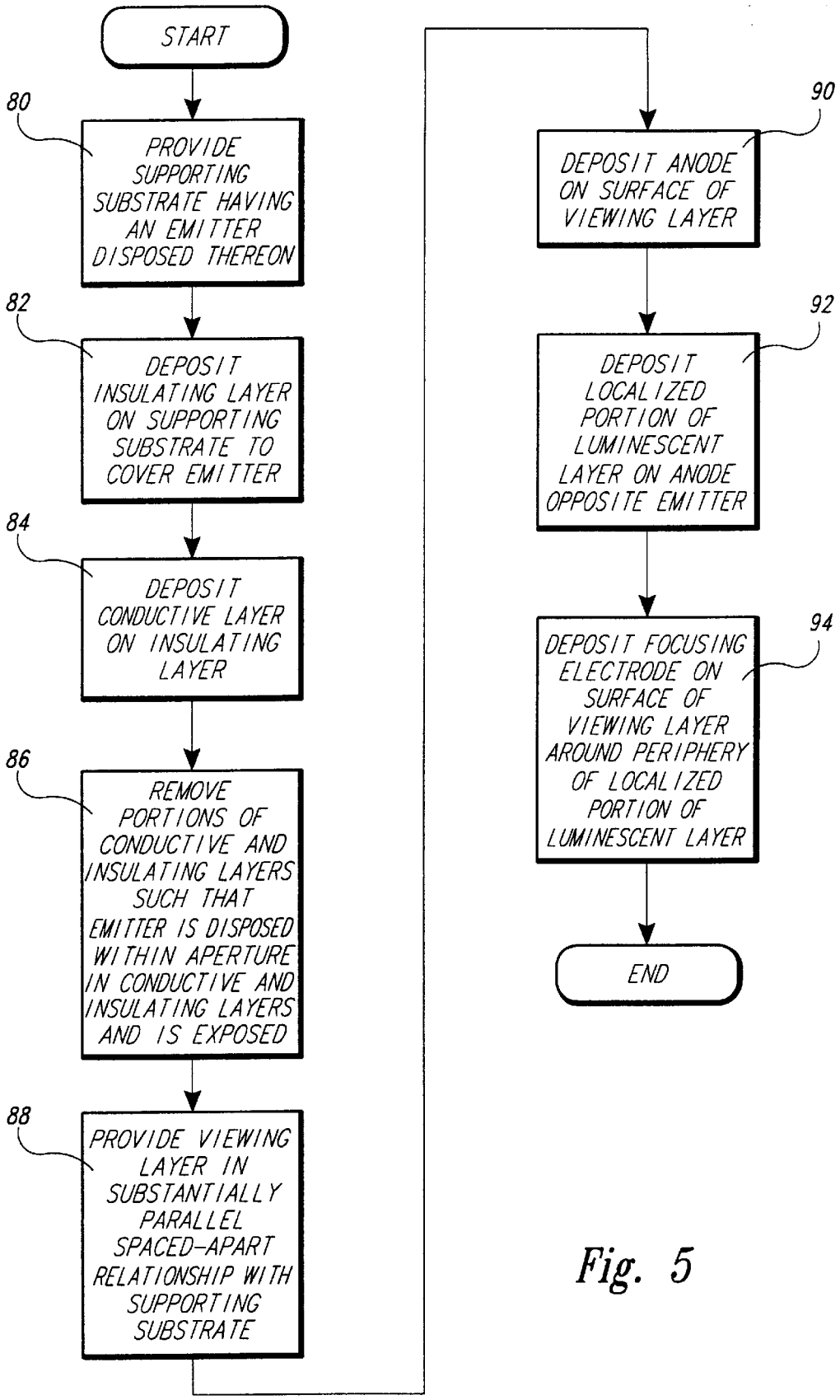
FIG. 5 is a flow diagram of a method for constructing a display device according to the present invention.

With reference to FIG. 5, in another embodiment the present invention provides a method for constructing a display device. In a step 80 a supporting substrate having a field-induced electron emitter disposed thereon is provided. Next, in a step 82 an insulating layer, such as a silicon dioxide dielectric layer, is deposited over the surface of the supporting substrate to cover the emitter. Then, in a further step 84 a conductive layer is deposited on the insulating layer. Next, in a step 86 portions of the conductive and insulating layers are removed so that the emitter is disposed within an aperture in the conductive and insulating layers and is exposed. This is preferably accomplished by etching. Then, in a still further step 88 a substantially transparent viewing layer is provided in a substantially parallel spaced-apart relationship with the supporting substrate and having a surface facing the supporting substrate. Next, in an additional step 90, an anode is deposited on the surface of the viewing layer. Then, in a still additional step 92, a localized portion of a luminescent layer is deposited on the anode opposite the emitter. Finally, in a further additional step 94, a focusing electrode comprising a conductive strip is deposited on the substantially planar surface of the viewing layer around the periphery of the localized portion of the luminescent layer. In this manner a display device may be constructed which operates in the same manner as the display device of the preferred electronic system described above. It will be understood that, although this method for constructing a display device is described in a series of sequential steps, the claims are not so limited. Rather, the claims encompass the practice of these steps in any order.

The present invention thus advantageously provides a field emission display device which successfully prevents bleedover even at high display resolutions by employing a focusing electrode at the anode. It should also be noted that the present invention will correct for the minor misalignments between the emitters and the localized portions of the luminescent layer in a field emission display device which are more likely to occur at higher display resolutions.

Although the present invention has been described with reference to a preferred embodiment, the invention is not limited to this preferred embodiment. Rather, the invention is limited only by the appended claims, which include within their scope all equivalent devices or methods which operate according to the principles of the invention as described.

I claim:

1. A display device comprising:

a baseplate comprising:

a supporting substrate;

an insulating layer positioned on the surface of the supporting substrate and having a plurality of apertures therein;

a plurality of field-induced electron emitters each carried by the supporting substrate and disposed within a respective aperture in the insulating layer; and a conductive layer positioned on the insulating layer peripherally about the apertures therein such that a conductive voltage applied to the conductive layer and a source voltage applied to the emitters will cause electron emission to occur from each of the emitters; and a faceplate comprising:

a substantially transparent, non-conductive viewing layer positioned in a substantially parallel spaced-apart relationship with the baseplate and having a substantially planar surface facing the baseplate;

a plurality of localized, spaced apart layers of conductive transparent material positioned on the substantially planar surface of the viewing layer opposite the emitters to form a plurality of anodes such that an anode voltage applied to each anode will direct the electron emissions from the emitters toward the anode;

a respective luminescent layer positioned on each anode opposite the emitters such that at least some of the electron emissions directed toward the anode will bombard a localized portion of the luminescent layer and cause it to emit light and to thereby provide a respective display;

a plurality of respective focusing electrodes surrounding the periphery of at least some of the anodes, each focusing electrode comprising a conductive strip positioned on the substantially planar surface of the viewing layer around the periphery of the localized portion of the luminescent layer substantially opposite the emitters such that a focusing electrode voltage applied to the focusing electrode which is less than the anode voltage will focus the electron emissions directed toward the anode on the localized portion of the luminescent layer; and an electrically insulating material coating at least some of the focusing electrodes.

2. The display device of claim 1 wherein the source voltage, the anode voltage, the focusing electrode voltage and the conductive voltage are different.

3. The display device of claim 1 wherein the luminescent layer comprises a phosphorescent layer.

4. The display device of claim 3 wherein the phosphorescent layer comprises a cathodophosphorescent layer.

5. The display device of claim 1 wherein the display device has a plurality of pixels each comprising one of the plurality of localized portions of the luminescent layer, each pixel thereby being associated with one of the sets of the emitters, the baseplate further comprising a plurality of emitter conductors each operatively coupled to the emitters of one of the sets of the emitters such that each set of the emitters is uniquely addressable by applying the conductive voltage to the conductive layer and by applying the source voltage to the emitter conductor operatively coupled to the emitters of the set of the emitters.

6. The display device of claim 1 wherein the display device has a plurality of color pixels each comprising a red, a blue and a green sub-pixel, each sub-pixel comprising one of the plurality of localized portions of the luminescent layer, each sub-pixel thereby being associated with one of the sets of the emitters, the baseplate further comprising a plurality of emitter conductors each operatively coupled to the emitters of one of the sets of the emitters such that each set of the emitters is uniquely addressable by applying the conductive voltage to the conductive layer and by applying the source voltage to the emitter conductor operatively coupled to the emitters of the set of the emitters.

7. The display device of claim 1 wherein the anode has a plurality of localized portions each uniquely associated with one of the plurality of localized portions of the luminescent layer.

8. The display device of claim 1 further comprising a layer of masking material surrounding the periphery of at least some of the localized portions of the luminescent layer to form a contrast mask.

9. The display device of claim 1 further comprising a layer of masking material coating at least a portion of some of the focusing electrodes to form a contrast mask.

10. The display device of claim 9 further comprising an electrically insulating material coating at least some of the focusing electrodes and the layer of masking material coating at least a portion of some of the focusing electrodes.

11. A display device comprising:

means for emitting an electron emission in response to an applied electric field;

means, positioned in a plurality of localized, spaced apart regions in substantially aligned relationship with the emitting means, for attracting the electron emission in response to receiving a first sufficient voltage;

means, positioned between the emitting means and the attracting means, for emitting light in response to receiving the electron emission and for thereby providing a display;

means, positioned around the periphery of each of the means for attracting regions for focusing the electron emission on the light emitting means in response to receiving a second sufficient voltage which is less than the first sufficient voltage; and an electrically insulating material coating at least some of the means for attracting the electron emission.

12. The display device of claim 11 wherein the emitting means comprises a baseplate including:

a supporting substrate;

an insulating layer positioned on the surface of the supporting substrate and having an aperture therein;

a field-induced electron emitter carried by the supporting substrate and disposed within the aperture in the insulating layer; and a conductive layer positioned on the insulating layer peripherally about the aperture therein such that a conductive voltage applied to the conductive layer and a source voltage applied to the emitter will cause the electron emission to occur from the emitter.

13. The display device of claim 11 wherein the attracting means comprises:

a substantially transparent non-conductive viewing layer positioned in a substantially parallel spaced-apart relationship with the emitting means and having a substantially planar surface facing the emitting means; and a plurality of localized, spaced apart layers of conductive transparent material positioned on the substantially planar surface of the viewing layer opposite the emitting means such that the first sufficient voltage comprising an anode voltage applied to the anode will direct the electron emission from the emitting means toward the anode.

14. The display device of claim 11 wherein the light emitting means comprises a luminescent layer positioned on the attracting means opposite the emitting means such that the first sufficient voltage applied to the attracting means will attract the electron emission from the emitting means toward a localized portion of the luminescent layer and cause the localized portion to emit light in response to receiving the electron emission and to thereby provide a display.

15. The display device of claim 11 wherein the focusing means comprises a focusing electrode comprising a conductive strip positioned around the periphery of the light emitting means substantially opposite the emitting means such that the second sufficient voltage comprising a focusing electrode voltage applied to the focusing electrode will focus the electron emission on the light emitting means.

16. The display device of claim 11 further comprising a layer of masking material surrounding the periphery of at least some of the means for emitting light to form a contrast mask.

17. The display device of claim 11 further comprising a layer of masking material coating at least a portion of some of the means for attracting the electron emission to form a contrast mask.

18. The display device of claim 17 further comprising an electrically insulating material coating at least some of the means for attracting the electron emission and the layer of masking material coating at least a portion of some of the means for attracting the electron emission.

19. A method for constructing a display device comprising:

providing a supporting substrate having a field-induced electron emitter disposed thereon;

depositing an insulating layer on the surface of the supporting substrate such that it covers the emitter;

depositing a conductive layer on the insulating layer;

removing portions of the conductive and insulating layers so that the emitter is exposed and is disposed within an aperture in the conductive and insulating layers, whereby a source voltage applied to the emitter and a conductive voltage applied to the conductive layer will cause an electron emission to occur from the emitter;

providing a substantially transparent non-conductive viewing layer in a substantially parallel spaced-apart relationship with the supporting substrate and having a substantially planar surface facing the supporting substrate;

forming a localized layer of conductive transparent material on the surface of the viewing layer opposite the emitter to form an anode such that an anode voltage applied to the anode will direct the electron emission from the emitter toward the anode;

providing a luminescent layer having a localized portion positioned on the anode opposite the emitter such that the electron emission directed toward the anode may bombard the localized portion and cause it to emit light and to thereby provide a display;

positioning a focusing electrode comprising a conductive strip on the substantially planar surface of the viewing layer around the periphery of the localized portion of the luminescent layer substantially opposite the emitter such that a focusing electrode voltage applied to the focusing electrode which is less than the anode voltage will focus the electron emission directed toward the anode on the localized portion of the luminescent layer; and coating the focusing electrode with an electrically insulating material.

20. The method of claim 19 further comprising the step of placing a layer of opaque material around the periphery of the luminescent layer to form a contrast mask.

21. The method of claim 19 further comprising the step of coating at least a portion of the focusing electrode with a layer of opaque material to form a contrast mask.

22. The method of claim 21 further comprising the step of coating the focusing electrode and the layer of opaque material with an electrically insulating material.

* * * * *